US010933655B2

(12) United States Patent
Moriyama

(10) Patent No.: US 10,933,655 B2
(45) Date of Patent: Mar. 2, 2021

(54) LIQUID EJECTING APPARATUS

(71) Applicant: SEIKO EPSON CORPORATION, Tokyo (JP)

(72) Inventor: Keita Moriyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/661,525

(22) Filed: Oct. 23, 2019

(65) Prior Publication Data

US 2020/0130363 A1 Apr. 30, 2020

(30) Foreign Application Priority Data

Oct. 26, 2018 (JP) ..... JP2018-201571

(51) Int. Cl.
*B41J 2/21* (2006.01)
*B41J 2/005* (2006.01)

(52) U.S. Cl.
CPC ..... *B41J 2/2114* (2013.01); *B41J 2/0057* (2013.01)

(58) Field of Classification Search
CPC .... B41J 2/2114; B41J 2/0057; B41J 2202/20; B41J 2/155; B41J 2/2146; B41J 2/2103; B41J 2/2107; B41J 2025/008; B41J 2/04; B41J 3/543; B41J 11/002; B41J 11/00
USPC ..... 347/21
See application file for complete search history.

(56) References Cited

U.S. PATENT DOCUMENTS

2011/0069113 A1* 3/2011 Shimizu ..... B41J 2/2117 347/22
2015/0145921 A1 5/2015 Washio
2017/0008273 A1* 1/2017 Kuwabara ..... B41J 11/0015

FOREIGN PATENT DOCUMENTS

CN 104669790 6/2015
JP 2011-067964 A 4/2011

* cited by examiner

*Primary Examiner* — Huan H Tran
*Assistant Examiner* — Alexander D Shenderov
(74) *Attorney, Agent, or Firm* — Workman Nydegger

(57) ABSTRACT

A liquid ejecting apparatus includes: a rotary member that rotates in a rotational direction; a first head unit that is disposed along a circumferential surface of the rotary member and ejects a first liquid; and a second head unit that ejects a second liquid whose property of attacking an organic material is stronger than the first liquid, in which an angle which an ejection surface of the second head unit forms with a horizontal plane is smaller than an angle which an ejection surface of the first head unit forms with the horizontal plane.

20 Claims, 5 Drawing Sheets

LIQUID EJECTING APPARATUS

The present application is based on, and claims priority from JP Application Ser. No. 2018-201571, filed Oct. 26, 2018, the disclosure of which is hereby incorporated by reference herein in its entirety.

BACKGROUND

1. Technical Field

The present disclosure relates to a liquid ejecting apparatus such as an ink jet printer.

2. Related Art

Ink jet printers are widely known as liquid ejecting apparatuses that eject liquid onto sheets of paper. Ink jet printers are hereinafter referred to as printers.

A head unit of such a printer includes a head provided with nozzles from which ink is ejected, a peripheral member that covers the periphery of the head, and a sealer disposed between the head and the peripheral member.

Around a transport drum that transports a sheet subjected to printing, head units are disposed so as to face the sheet. Specifically, with a sheet placed around the transport drum so as to conform to the shape of the transport drum, head units each including more than one head are disposed so as to face the sheet.

The printer includes head unit groups that eject corresponding types of ink. One of these types of ink is, for example, a clear ink disclosed in JP-A-2011-067964.

The property of causing swelling or dissolution of an organic material used as a sealer or other members disposed adjacent to the surfaces on which the nozzles of the head units are formed may be strong in some types of ink, that is, some of these types of ink have a strong attack property. With a head unit ejecting an ink having such a strong attack property, droplets of the clear ink landing on an ejection surface at the time of ejection may be moved by gravity onto a member such as the sealer and may consequently cause swelling or dissolution of the member.

SUMMARY

A liquid ejecting apparatus according to the present application includes: a rotary member that rotates in a rotational direction; a first head unit that is disposed along a circumferential surface of the rotary member and ejects a first liquid; and a second head unit that ejects a second liquid whose property of attacking an organic material is stronger than the first liquid, wherein an angle which an ejection surface of the second head unit forms with a horizontal plane is smaller than an angle which an ejection surface of the first head unit forms with the horizontal plane.

DESCRIPTION OF EXEMPLARY EMBODIMENTS

Hereinafter, liquid ejecting apparatuses according to embodiments of the present disclosure will be described with reference to the drawings.

First Embodiment

Figure 1:
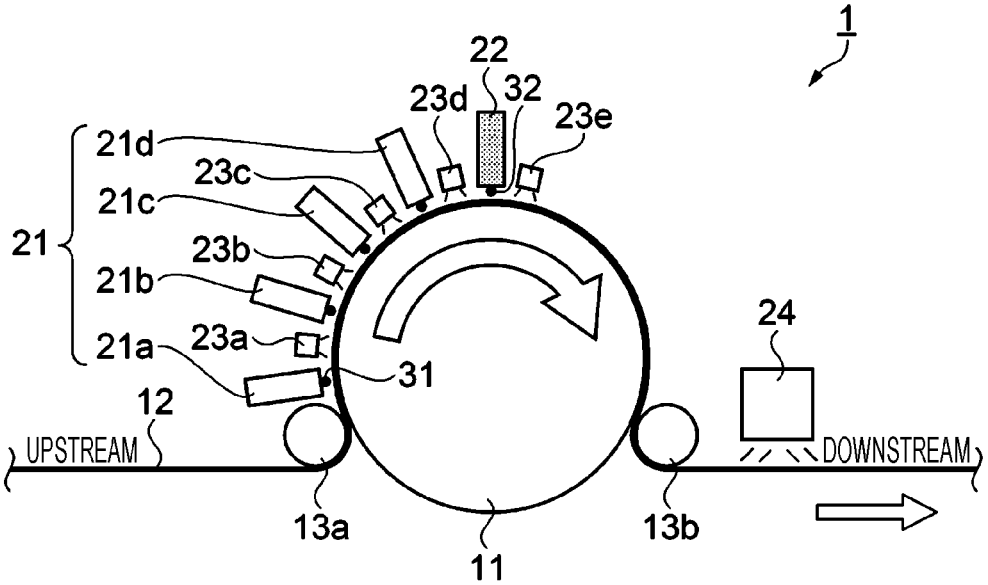
FIG. 1 is a schematic diagram illustrating a configuration of a printer according a first embodiment.

FIG. 1 is a schematic diagram illustrating a configuration of a printer that is a liquid ejecting apparatus. Referring to FIG. 1, the following describes the configuration of the printer.

A printer 1 includes: a transport drum 11, which is a rotary member; a first head unit group 21 disposed along a circumferential surface of the transport drum 11; and a second head unit 22. A sheet 12, which is a recording medium made of paper, is placed on the circumferential surface of the transport drum 11. The transport drum 11 rotates in the direction of the arrow of FIG. 1 (a rotational direction) to transport the sheet 12 downstream in a rotational direction.

The recording medium is not limited to the sheet 12 that is made of paper and may be a sheet of cloth or a sheet of film. By the action of an electrostatic attraction device or a vacuum attraction device of the transport drum 11, the sheet 12 is held so as to stick to the circumferential surface of the transport drum 11.

An upstream transport roller 13*a* and a downstream transport roller 13*b* are disposed alongside the transport drum 11. The upstream transport roller 13*a* is disposed upstream of the downstream transport roller 13*b* in the transport direction (rotational direction), in which the sheet 12 is transported. The downstream transport roller 13*b* is disposed downstream of the upstream transport roller 13*a* in the transport direction (rotational direction). The upstream transport roller 13*a* and the downstream transport roller 13*b* transport the sheet 12 in such a manner that the sheet 12 is pinched between the transport drum 11 and each transport roller. A drive device (not illustrated) causes the upstream transport roller 13*a* and the downstream transport roller 13*b* to rotate at a substantially constant speed in synchronization with each other, and the sheet 12 is transported accordingly.

Around the transport drum 11, first head units constituting the first head unit group 21 (e.g., four first head units, namely, first head units 21*a*, 21*b*, 21*c*, and 21*d*) are disposed so as to face the transport drum 11 and the sheet 12. The first head units 21*a* to 21*d* eject an ink 31, which is a first liquid, to achieve printing on the sheet 12 placed around the transport drum 11. The ink 31 in the present embodiment may be an ultraviolet-curable ink (UV ink), which is cured by irradiation with light such as ultraviolet (UV) rays. The first head units 21*a* to 21*d*, which are four different head units for four different colored inks, are disposed around the transport drum 11.

The second head unit 22 is disposed downstream of the first head unit group 21 in the transport direction (rotational direction). The second head unit 22 ejects a clear ink 32, which is a second liquid for enhancing weatherability of the print side of a printed sheet. The clear ink in the present embodiment is an ink whose property of attacking an organic material is stronger than that of the ink ejected from the first head unit group 21. The attack property referred to in the present embodiment means that a member can swell or dissolve on contact with the clear ink.

Pre-curing units 23*a*, 23*b*, 23*c*, and 23*d* are disposed downstream of the first head units 21*a*, 21*b*, 21*c*, and 21*d*, respectively. For example, the pre-curing unit 23*a* performs pre-curing to suppress the spreading of droplets of the ink 31 ejected from the first head unit 21*a* onto the sheet 12. Similarly, a pre-curing unit 23*e* is disposed downstream of the second head unit 22.

A main-curing unit 24, which performs main curing, is disposed downstream of the downstream transport roller 13*b* and irradiates the entire region having printing thereon with UV rays to cure the ultraviolet-curable ink 31.

Figure 2:
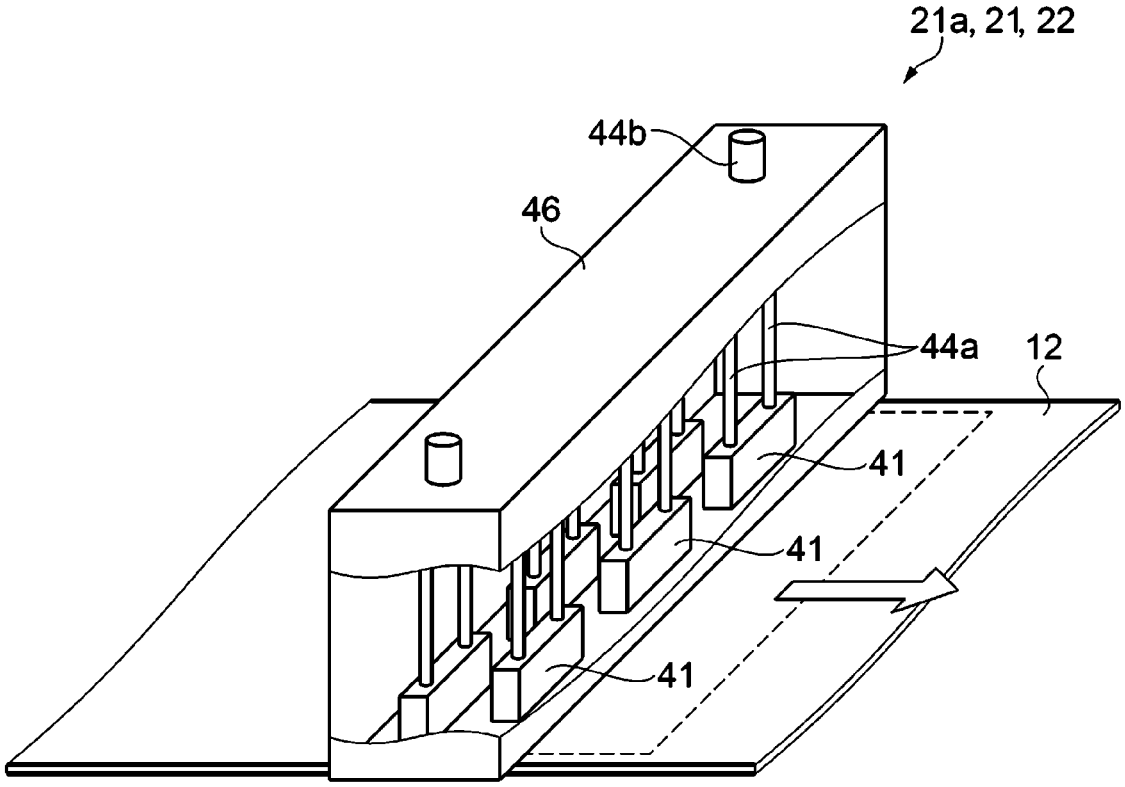
FIG. 2 is a perspective view of a first head unit, illustrating a configuration thereof.
Figure 3:
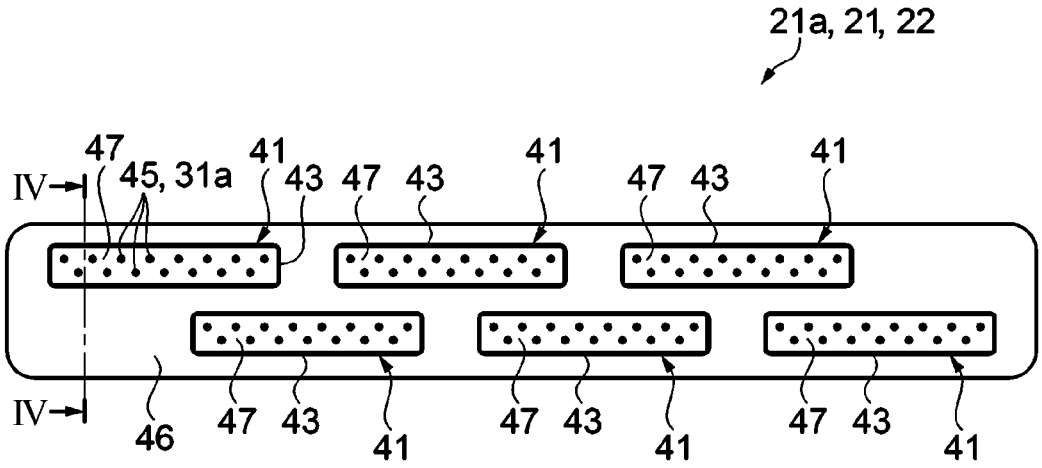
FIG. 3 is a plan view of a first head unit from an ink ejection surface side, illustrating a configuration thereof.
Figure 4:
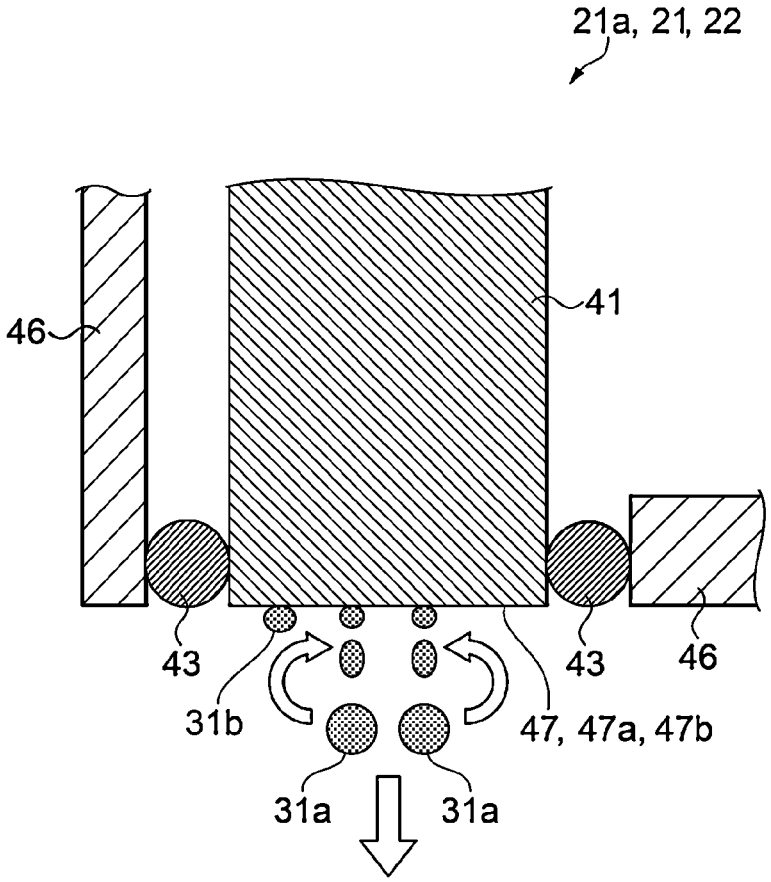
FIG. 4 is a schematic sectional view of the first head unit taken along line IV-IV in FIG. 3.

FIG. 2 is a perspective view of one of the first head units, illustrating a configuration thereof. FIG. 3 is a plan view of the first head unit from an ink ejection surface side, illustrating a configuration thereof. FIG. 4 is a schematic sectional view of the first head unit taken along line IV-IV in FIG. 3. Referring to FIGS. 2 to 4, the following describes the configuration of the first head unit. Of the first head units 21*a* to 21*d*, the first head unit 21*a* will be taken as an example and the configuration thereof will be described.

As illustrated in FIGS. 2 to 4, the first head unit 21*a* includes: a plurality of first heads 41; a sealer 43 provided to protect the first heads 41 and made of an organic material; pipes 44*a* and 44*b* through which the ink 31 is fed to the first heads 41; and a peripheral member 46 protecting electric signal wiring (not illustrated) coupled to the individual first heads 41 so as to cause the ink 31 to be ejected from desired nozzles of nozzles 45.

As illustrated in FIG. 3, the first heads 41 extend in the longitudinal direction of the first head unit 21*a* and are arranged in a staggered pattern.

The sealer 43 is made of an organic material as mentioned above and is disposed so as to surround the peripheries of the individual first heads 41. As illustrated in FIG. 4, the sealer 43 is disposed so as to surround the periphery of each first head 41 and thus suppresses the entry of ink droplets 31*b* landing on an ejection surface 47*a* of the first head 41 into the first head unit 21*a*.

The nozzles 45 provided in the first head 41 are arranged in two rows in the longitudinal direction of the first head 41. The printer 1 according to the present embodiment is, for example, a line printer, in which each first head unit provides dots aligned across the width of the printable region to form an image all at once.

The first head unit 21*a* having the above configuration ejects ink droplets 31*a* from the nozzles 45 onto the sheet 12 being transported and thus forms ink dots on the print side of the sheet 12, and thereby, an image is printed. The second head unit 22 has a configuration similar to that of the first head unit 21*a*.

The ejection of the ink droplets 31*a* from the first heads 41 causes a difference in pressure between the area adjacent to the nozzles 45 and the area surrounding the ejection surfaces 47*a*. The difference in pressure creates an airflow (hereinafter referred to as a self-jet) upon ejection of the ink droplets 31*a*. Of the ejected ink droplets 31*a*, ink droplets 31*a* of lower weight can land on the ejection surfaces 47*a* due to the self-jet. Moreover, repeated ejection of the ink droplets 31*a* by each first head 41 leaves a build-up of ink droplets 31*a* landing on the ejection surface 47*a* thereof, and a mass of ink droplets 31*b* can be formed on the ejection surface 47*a* accordingly.

Figure 5:
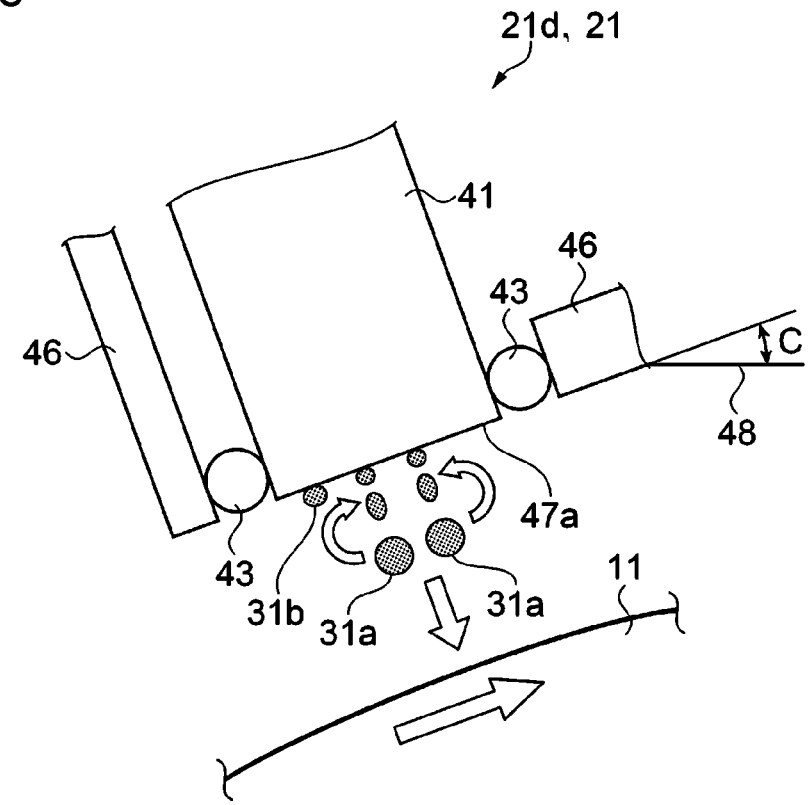
FIG. 5 is a schematic diagram illustrating the first head unit ejecting ink droplets.
Figure 6:
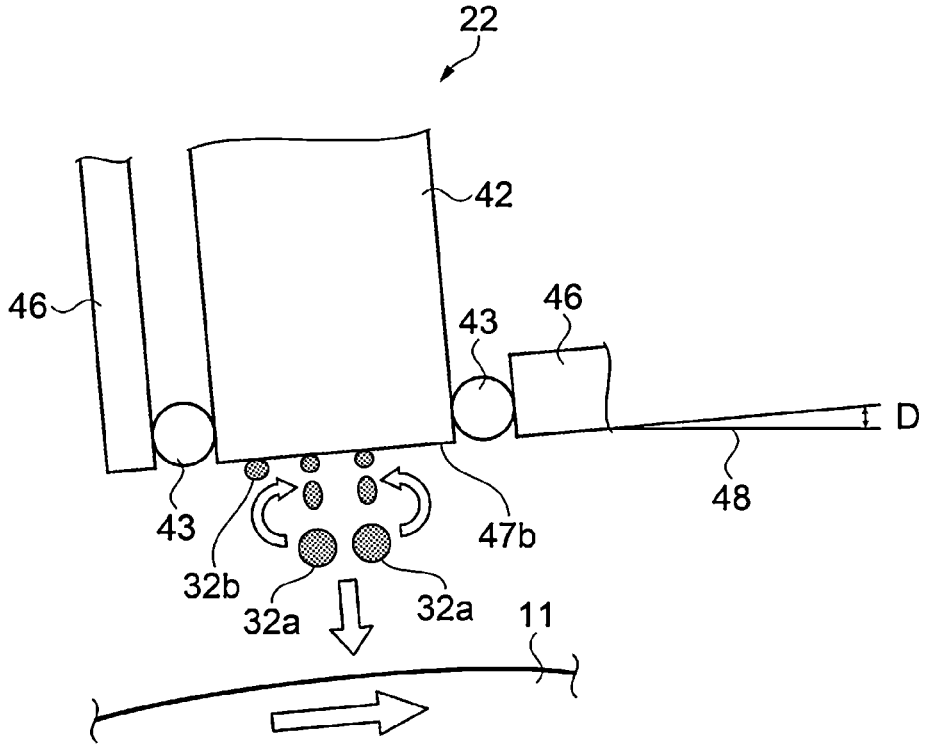
FIG. 6 is a schematic diagram illustrating a second head unit ejecting clear-ink droplets.

FIG. 5 is a schematic diagram illustrating the first head unit ejecting ink droplets. FIG. 6 is a schematic diagram illustrating the second head unit ejecting clear-ink droplets. Referring to FIGS. 1, 5, and 6, the following describes the ejection state of the individual first head units and the ejection state of the second head unit. The following description will be based on a comparison of the first head unit 21*d*, which is included in the first head unit group 21 and disposed adjacent to the second head unit 22, and the second head unit 22.

As illustrated in FIG. 1, the second head unit 22 including second heads 42 in the present embodiment is disposed near the top of the transport drum 11, that is, immediately above the transport drum 11. The first head units 21*a* to 21*d* are disposed along the circumferential surface of the transport drum 11 and are arranged between the second head unit 22 and the upstream transport roller 13*a*.

As illustrated in FIG. 5, an angle C denotes, for example, the angle which the ejection surface 47*a* of the first head unit 21*d* forms with a horizontal plane 48. As illustrated in FIG. 6, an angle D denotes the angle which the ejection surface 47*b* of the second head unit 22 forms with the horizontal plane 48.

As illustrated in FIGS. 5 and 6, the angle D which the ejection surface 47*b* of the second head unit 22 forms with the horizontal plane 48 is smaller than the angle C which the ejection surface 47*a* of the first head unit 21*d* forms with the horizontal plane 48.

As the second liquid to be ejected by the second head unit 22, a liquid whose property of attacking the sealer 43 is stronger than that of the first liquid to be ejected by the first head unit 21*d* is selected.

Each liquid may be evaluated for the property of attacking the sealer 43 in a simplified manner by determining whether there is any change in weight after the sealer 43 is impregnated with the liquid for a certain period of time at the ambient temperature at which the liquid is to be used (e.g., for 10 hours at an ambient temperature of 25 degrees Celsius). A greater difference in weight between before and after the impregnation implies that the attack property is stronger.

In the present embodiment, the clear ink, the constituents of which differ from those of other colored inks to provide enhanced weatherability, caused the greatest difference in weight between before and after the impregnation was thus adopted as the second liquid.

With the second head unit 22 and the first head unit 21*d* arranged as described above, the angle which the ejection surface 47*b* of the second head unit 22 forms with the horizontal plane 48 is smaller than the angle which the ejection surface 47*a* of the first head unit 21*d* forms with the horizontal plane 48. When the clear ink 32 is ejected from the second head unit 22, clear-ink droplets 32*a* landing on the ejection surface 47*b* are thus kept from being moved by gravity. This suppresses swelling or dissolution of components constituting the second head unit 22, which might otherwise occur due to contact with clear-ink droplets 32*b*.

As described above, the printer 1 according to the first embodiment provides the following effects.

(1) According to the first embodiment, the angle which the ejection surface 47*b* of the second head unit 22 forms with the horizontal plane is smaller than the angle which the ejection surface 47*a* of the first head unit 21*d* forms with the horizontal plane. When the clear ink droplets 32*a* are ejected from the second head unit 22, the clear-ink droplets 32*a* landing on the ejection surface 47*b* of the second head unit 22 are thus kept from being moved by gravity. This suppresses swelling or dissolution of components of the second head unit 22, that is, deterioration of the components of the second head unit 22, which might otherwise occur due to contact with the clear-ink droplets 32*b*.

(2) According to the first embodiment, the first head unit group 21 and the second head unit 22 are disposed along the circumferential surface of the transport drum 11, and this configuration makes the printer 1 reduce in size in the transport direction.

Second Embodiment

Figure 7:
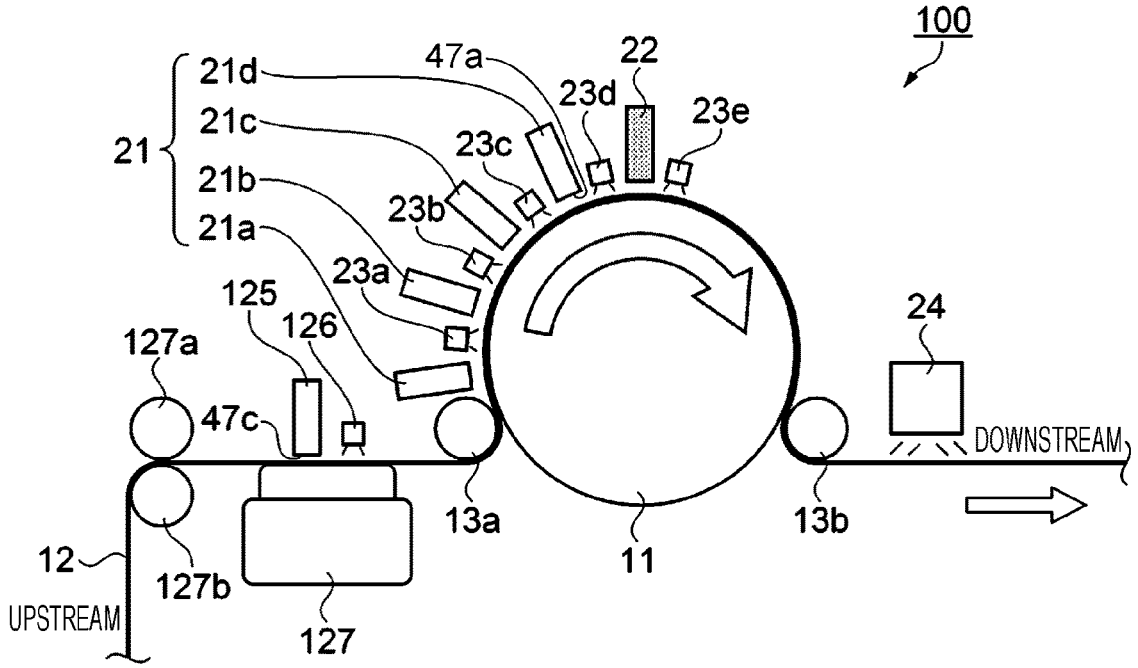
FIG. 7 is a schematic diagram illustrating a configuration of a printer according a second embodiment.

FIG. 7 is a schematic diagram illustrating a configuration of a printer according a second embodiment. Referring to FIG. 7, the following describes the configuration of the printer according to the second embodiment.

The printer 1 according to the first embodiment includes the first head unit group 21 and the second head unit 22, whereas a printer 100 according to the second embodiment further includes a third head unit 125 disposed upstream of the first head unit group 21. The second embodiment is otherwise substantially similar to the first embodiment, and the following gives detailed description of components distinct from those of the first embodiment and omits description of the components common to these embodiments.

As illustrated in FIG. 7, the printer 100 according to the second embodiment includes the third head unit 125, a pre-curing unit 126, a paper rest 127, an upper feeding roller 127*a*, and a lower feeding roller 127*b*, which are all disposed upstream of the first head unit group 21 and the upstream transport roller 13*a*.

The pre-curing unit 126 is disposed downstream of the third head unit 125. The paper rest 127 is disposed so as to face the third head unit 125 and the pre-curing unit 126.

The paper rest 127 holds the sheet 12 by vacuum attraction or electrostatic attraction. The sheet 12 is transported by the upper feeding roller 127*a* and the lower feeding roller 127*b* and is placed onto the paper rest 127 accordingly.

The angle which an ejection surface 47*c* of the third head unit 125 forms with the horizontal plane is smaller than the angle which the ejection surface 47*a* of the first head unit 21*d* forms with the horizontal plane.

A third liquid to be ejected from the third head unit 125 has the same level of attack property that the second liquid has. In light of formation of images, it is required that the third head unit 125, which ejects the third liquid, be disposed upstream of the first head unit group 21. A white ink, which is a coloring material, is selected as the third liquid in the present embodiment. The third head unit 125, which ejects the white ink, is disposed upstream of the first head unit group 21 so that an image is printed in the white ink and then overprinted in colored inks, thus enabling colors to come out well.

As described above, the printer 100 according to the second embodiment provides the following effects.

(3) According to the second embodiment, which involves ejection of the white ink having the same level of attack property that the clear ink 32 has, droplets of the white ink landing on the ejection surface 47*c* of the third head unit 125 during ejection of the white ink are kept from being moved by gravity because the angle which the ejection surface 47*c* of the third head unit 125 forms with the horizontal plane is smaller than any angles which the ejection surfaces of the first head unit group 21 form with the horizontal plane. This suppresses swelling or dissolution of components of the third head unit 125, which might otherwise occur when droplets of the white ink come into contact with the third head unit 125.

Third Embodiment

Figure 8:
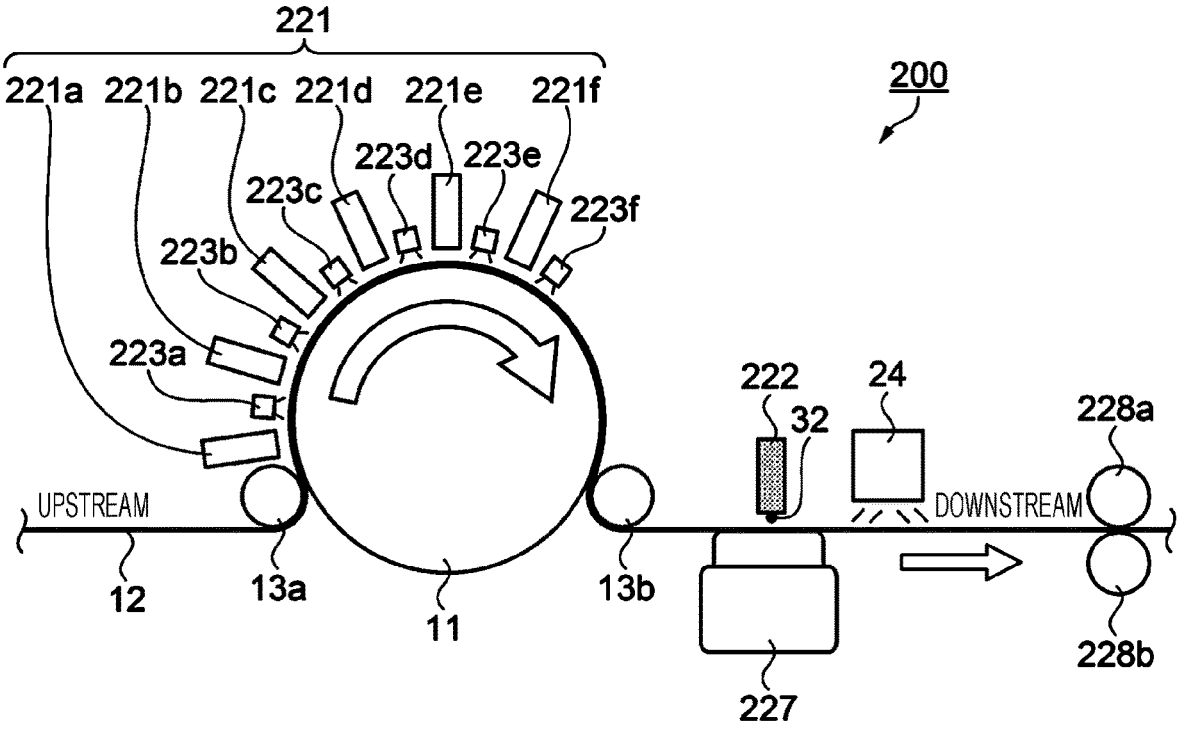
FIG. 8 is a schematic diagram illustrating a configuration of a printer according a third embodiment.

FIG. 8 is a schematic diagram illustrating a configuration of a printer according a third embodiment. Referring to FIG. 8, the following describes the configuration of the printer according to the third embodiment.

The printer 1 according to the first embodiment includes the first head unit group 21 and the second head unit 22 both disposed between the upstream transport roller 13*a* and the downstream transport roller 13*b*, whereas a printer 200 according to the third embodiment includes: a first head unit group 221 disposed between the upstream transport roller 13*a* and the downstream transport roller 13*b*; and a second head unit 222 disposed downstream of the downstream transport roller 13*b*. The third embodiment is otherwise substantially similar to the first embodiment, and the following gives detailed description of components distinct from those of the first embodiment and omits description of the components common to these embodiments.

As illustrated in FIG. 8, the printer 200 according to the third embodiment includes the first head unit group 221 disposed along the circumferential surface of the transport drum 11 and disposed between the upstream transport roller 13*a* and the downstream transport roller 13*b*.

The liquid to be ejected from the first head unit group 221 is the first liquid. The first liquid in the present embodiment includes white, cyan, magenta, yellow, black, and orange inks.

The first head unit group 221 includes, for example, a first head unit 221*a* that ejects a white ink, a first head unit 221*b* that ejects a cyan ink, a first head unit 221*c* that ejects a magenta ink, a first head unit 221*d* that ejects a yellow ink, a first head unit 221*e* that ejects a black ink, and a first head unit 221*f* that ejects an orange ink.

Pre-curing units 223*a*, 223*b*, 223*c*, 223*d*, 223*e*, and 223*f* are disposed downstream of the first head units 221*a* to 221*f*, respectively. Unlike the first head unit group 21 of the printer 1 according to the first embodiment or the printer 100 according to the second embodiment, the first head unit group 221 in the present embodiment is disposed so as to extend beyond the position immediately above the transport drum 11.

The second head unit 222, which ejects the clear ink 32, is disposed downstream of the downstream transport roller 13*b*. A paper rest 227 is disposed so as to face the second head unit 222. The main-curing unit 24 is disposed downstream of the second head unit 222.

An upper pull-in roller 228*a* and a lower pull-in roller 228*b* are disposed downstream of the main-curing unit 24. The sheet 12 is transported by the downstream transport roller 13*b*, the upper pull-in roller 228*a*, and the lower pull-in roller 228*b* and is placed onto the paper rest 227 accordingly.

In the printer 200 according to the present embodiment, in which many first head units constituting the first head unit group 221, namely, the first head units 221*a* to 221*f* may be disposed along the circumferential surface of the transport drum 11, the second head unit 222 is disposed downstream of the downstream transport roller 13*b* and on a relatively planar spot. Owing to this configuration, the angle which the ejection surface of the second head unit 222 forms with the horizontal plane is smaller than any angles which the ejection surfaces of the first head units 221*a* to 221*f* form with the horizontal plane. The droplets of the clear ink 32 landing on the ejection surface of the second head unit 222 are thus kept from being moved by gravity. This suppresses swelling or dissolution of components of the second head unit 222, which might otherwise occur due to contact with the clear ink 32. Furthermore, the incorporation of colors other than cyan, magenta, and yellow enables a further improvement in image quality.

As described above, the printer 200 according to the third embodiment provides the following effects.

(4) According to the third embodiment, in which many first head units constituting the first head unit group 221, namely, the first head units 221*a* to 221*f* may be disposed, the second head unit 222 is disposed downstream of the downstream transport roller 13*b* and on a relatively planar spot. Owing to this configuration, the angle which the ejection surface of the second head unit 222 forms with the horizontal plane is smaller than any angles which the ejection surfaces of the first head units 221*a* to 221*f* form with the horizontal plane. The droplets of the clear ink 32 landing on the ejection surface of the second head unit 222 are thus kept from being moved by gravity. This suppresses swelling or dissolution of components of the second head unit 222, which might otherwise occur due to contact with the clear ink 32.

(5) According to the third embodiment, the first head unit group 221 enables a further improvement in image quality owing to the incorporation of colors other than cyan, magenta, and yellow.

Modifications

The embodiments above may be altered as will be described below.

Figure 9:
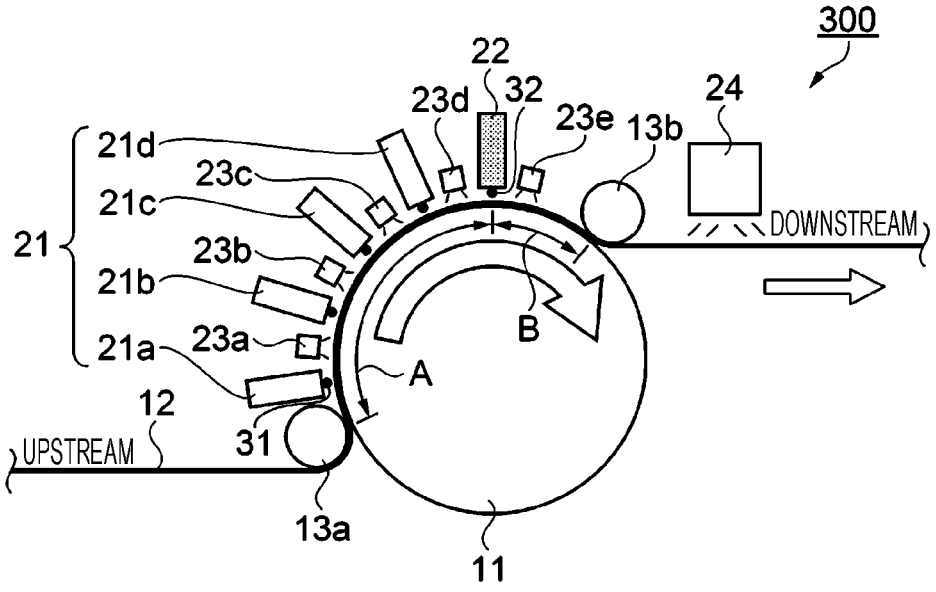
FIG. 9 is a schematic diagram illustrating a configuration of a printer according a modification.

The upstream transport roller 13*a* and the downstream transport roller 13*b*, which are disposed as illustrated in FIG. 1 in the first embodiment above, may be disposed as illustrated in FIG. 9. A printer 300 illustrated in FIG. 9 differs from the printer 1 according to the first embodiment in that the downstream transport roller 13*b* is disposed closer to the head unit 22, that is, more upstream. In this configuration, in which the downstream transport roller 13*b* is disposed more upstream, a distance A over which the upstream transport roller 13*a* holds the sheet 12 upstream of the second head unit 22 in the transport direction is longer than a distance B over which the downstream transport roller 13*b* holds the sheet 12 downstream of the second head unit 22 in the transport direction. In other words, this configuration enables the distance B to be shorter than the distance A. Thus, the liquid ejecting apparatus reduces in size in the transport direction.

In the embodiments above, one second head unit 22 is disposed. Alternatively, more than one second head units 22 may be disposed in such a manner that liquids to be ejected by the respective second head units 22 are arranged in the order of descending level of the property of attacking an organic material. In some embodiments, a head unit that ejects a liquid whose property of attacking an organic material is stronger than that of all the other liquids to be ejected by the respective remaining head units may be designated as the second head unit.

In the second embodiment above, one third head unit 125, which ejects a white ink, is disposed. In some embodiments, head units that eject liquids whose property of attacking an organic material is strong (e.g., cyan, magenta, yellow, and black inks) may be disposed alongside the third head unit 125.

In the third embodiment above, the first head unit group 221 includes the first head units, each of which is provided for a corresponding one of the colors concerned. Alternatively, the number of first head units disposed to eject a white or black ink or any other ink that is typically used in large quantities may be more than one. The use of multiple head units for such an ink typically used in large quantities requires less frequent refilling, thus leading to reduced downtime.

The following describes the features drawn from the embodiments.

A liquid ejecting apparatus includes: a transport drum that transports in a transport direction a recording medium held on a circumferential surface thereof; a first head unit disposed along the circumferential surface of the transport drum to eject a first liquid; and a second head unit that ejects a second liquid whose property of attacking an organic material is stronger than that of the first liquid, in which the angle which an ejection surface of the second head unit forms with a horizontal plane is smaller than the angle which an ejection surface of the first head unit forms with the horizontal plane.

In this configuration, the angle which the ejection surface of the second head unit forms with the horizontal plane is smaller than the angle which the ejection surface of the first head unit forms with the horizontal plane, and droplets of the second liquid landing on the ejection surface of the second head unit during ejection of the second liquid are thus kept from being moved by gravity. This suppresses swelling or dissolution of components of the second head unit, that is, deterioration of the components, which might otherwise occur due to contact with the second liquid.

In a desirable configuration of the liquid ejecting apparatus above, the second head unit is disposed along the circumferential surface of the transport drum and is disposed so as to face the recording medium.

When the number of second head units is more than one, this configuration, in which the second head units are disposed along the circumferential surface of the transport drum, enables the liquid ejecting apparatus to reduce in size in the transport direction.

In a desirable configuration of the liquid ejecting apparatus above, the distance over which the transport drum holds the recording medium upstream of the second head unit in the transport direction (rotational direction) is longer than the distance over which the transport drum holds the recording medium downstream of the second head unit in the transport direction (rotational direction).

This configuration enables the distance over which the transport drum holds the recording medium downstream of the second head unit in the transport direction to be short when the angle which the ejection surface forms with the horizontal plane is small, that is, when the second head unit is disposed immediately above the transport drum and the first head unit is disposed upstream in the transport direction (rotational direction) and away from the transport drum. Thus, the liquid ejecting apparatus reduces in size in the transport direction.

In a desirable configuration of the liquid ejecting apparatus above, a curing unit is disposed downstream of the second head unit in the transport direction (rotational direction) and along the circumferential surface of the transport drum and cures the second liquid.

This configuration, in which the second head unit and the curing unit are disposed along the circumferential surface of the transport drum and are thus disposed at a short distance apart in the transport direction (rotational direction), enables the liquid ejecting apparatus to reduce in size.

In a desirable configuration of the liquid ejecting apparatus, the second head unit is disposed downstream of the first head unit in the transport direction (rotational direction).

This configuration, in which the second head unit is disposed downstream of the first head unit, reduces the possibility that an airflow generated between a recording medium and the head unit due the transport of the recording medium could cause some droplets of the second liquid ejected from the second head unit to land on the first head unit. This suppresses deterioration of components of the first head unit, which might be otherwise caused by attack from the second liquid.

In a desirable configuration of the liquid ejecting apparatus above, a third head unit is disposed upstream of the first head unit in the transport direction (rotational direction) to eject a third liquid whose property of attacking an organic material is stronger than that of the first liquid, the third liquid containing a coloring material, in which the angle which an ejection surface of the third head unit forms with the horizontal plane is smaller than the angle which the ejection surface of the first head unit forms with the horizontal plane.

In this configuration, the angle which the ejection surface of the third head unit forms with the horizontal plane is smaller than the angle which the ejection surface of the first head unit forms with the horizontal plane, and droplets of the third liquid landing on the ejection surface of the third head unit during ejection of the third liquid are thus kept from being moved by gravity. This suppresses swelling or dissolution of components of the third head unit, that is, deterioration of the components, which might otherwise occur due to contact with the third liquid.

Although a product line of liquid ejecting apparatuses has been described above in which the transport drum 11 is used as a rotary member, other embodiments are also possible. For example, each embodiment is applicable to a product line in which an intermediate transfer member is used as a rotary member.

The intermediate transfer member is configured as described below. The first head unit 21 and the second head unit 22 are disposed along the circumferential surface of the intermediate transfer member. With a support member (platen) disposed adjacent to the lower portion of the intermediate transfer member to support a recording medium being transported, the intermediate transfer member is capable of coming into contact with the recording medium on the support member.

The first head unit 21 and the second head unit 22 respectively eject the clear ink 31 and the clear ink 32 on the circumferential surface of the intermediate transfer member, and an intermediate image is formed on the circumferential surface of the intermediate transfer member accordingly. Subsequently, the intermediate transfer member rotates in the rotational direction to bring the intermediate image into contact with the recording medium on the support member.

Then, the intermediate transfer member is pressed against the recording medium to transfer the intermediate image on the circumferential surface of the intermediate transfer member to the recording medium, and an image is formed on the recording medium accordingly. Heat may be applied by a heater to facilitate the transfer. A release agent may be applied in advance to aid the first head unit 21 or the second head unit 22 in the execution of efficient transfer. Subsequent to the transfer, the recording medium is transported by, for example, transport rollers separate from the intermediate transfer member and is ejected accordingly.

The present disclosure is also applicable to a product line in which such an intermediate transfer member is used as the rotary member above. Specifically, when the first head unit 21 and the second head unit 22 both disposed along the circumferential surface of the intermediate transfer member are arranged in such a manner that the angle which the ejection surface of the second head unit 22 forms with the horizontal plane is smaller than the angle which the ejection surface of the first head unit 21 forms with the horizontal plane, droplets of the second liquid landing on the ejection surface of the second head unit 22 are kept from being moved by gravity, and components are thus less prone to deterioration.

Although a product line of liquid ejecting apparatuses has been described above in which the angle which the ejection surface of the second head unit 22 forms with the horizontal plane is smaller than any angles which the ejection surfaces of the individual first head units 21 form with the horizontal plane, other embodiments are also possible. Of two head units, the second head unit 22 ejects a liquid whose property of attacking an organic material is stronger than that of the liquid ejected from the first head unit 21, with the angle which the ejection surface of the second head unit 22 forms with the horizontal plane being smaller than the angle which the ejection surface of the first head unit 21 forms with the horizontal plane. This configuration provides an intended effect. Specifically, droplets of the second liquid landing on the ejection surface of the second head unit 22 are further kept from being moved by gravity in this configuration than would be possible in the configuration where the angle which the ejection surface of the second head unit 22 forms with the horizontal plane is greater than the angle which the ejection surface of the first head unit 21 forms with the horizontal plane.

A product line of liquid ejecting apparatuses has been described above in which the ejection surface of the second head unit 22 is angled with respect to the horizontal plane to some extent, with the angle therebetween being as narrow as the angle D illustrated in FIG. 6. In a preferable configuration, however, the angle D is substantially 0 degrees. That is, the ejection surface of the second head unit 22 in the preferable configuration is substantially parallel to the horizontal plane.

Although a product line of liquid ejecting apparatuses has been described above in which the clear ink whose property of attacking an organic material is stronger than that of the other types of ink concerned, other embodiments are also possible. For example, the angle which the ejection surface of the head unit for a basic-color ink (i.e., a cyan, magenta, yellow, or black ink) whose property of attacking an organic material is stronger than that of the other basic-color inks forms with the horizontal plane is smaller than any angles which the ejection surfaces of the individual head units for the other basic-color inks form with the horizontal plane. In addition to the basic-color inks and the clear ink, a reaction liquid containing no coloring material and reactive to the basic-color inks may be used in an alternative product line. Reaction liquids are preferred which react on contact with the basic-color inks to provide the inks with enhanced fixation to the recording medium or improved releasability from the intermediate transfer member, where applicable. In a product line involving the use of such a reaction liquid whose property of attacking an organic material is stronger than that of the other liquids concerned, the head units are arranged in such a manner that the angle which the ejection surface of the head unit for the reaction liquid forms with the horizontal plane is smaller than any angles which the ejection surfaces of the individual head units for the other liquids form with the horizontal plane, where effects similar to those of the embodiments above may be attained.

What is claimed is:

1. A liquid ejecting apparatus comprising:

a rotary member that rotates in a rotational direction;

a first head unit that is disposed along a circumferential surface of the rotary member, includes an organic material, and ejects a first liquid; and a second head unit that includes the organic material and ejects a second liquid, wherein the second liquid swells the organic material more than the first liquid, and wherein an angle which an ejection surface of the second head unit forms with a horizontal plane is smaller than an angle which an ejection surface of the first head unit forms with the horizontal plane.

2. The liquid ejecting apparatus according to claim 1, wherein the second head unit is disposed along the circumferential surface of the rotary member.

3. The liquid ejecting apparatus according to claim 1, wherein the second head unit is disposed downstream of the first head unit in the rotational direction.

4. The liquid ejecting apparatus according to claim 1, wherein the liquid ejecting apparatus includes a plurality of first head units that are disposed along the circumferential surface of the rotary member and eject the first liquid, and the angle which the ejection surface of the second head unit forms with the horizontal plane is smaller than any angles which ejection surfaces of the plurality of first head units form with the horizontal plane.

5. The liquid ejecting apparatus according to claim 1, wherein the ejection surface of the second head unit is substantially parallel to the horizontal plane.

6. The liquid ejecting apparatus according to claim 1, wherein the second liquid is a clear ink.

7. The liquid ejecting apparatus according to claim 1, wherein the second liquid is a cyan ink, a magenta ink, a yellow ink, or a black ink.

8. The liquid ejecting apparatus according to claim 1, wherein the second liquid is a reaction liquid that reacts with the first liquid.

9. The liquid ejecting apparatus according to claim 1, further comprising a support that supports a recording medium being transported, wherein the rotary member is an intermediate transfer member that transfers an intermediate image to the recording medium by a circumferential surface of the intermediate transfer member coming into contact with the recording medium on the support after the intermediate image is formed on the circumferential surface by ejection of the first liquid and the second liquid.

10. The liquid ejecting apparatus according to claim 1, wherein the rotary member is a transport drum that supports a recording medium and transports the recording medium downstream in the rotational direction.

11. The liquid ejecting apparatus according to claim 10, wherein a distance over which the transport drum holds the recording medium upstream of the second head unit in the rotational direction is longer than a distance over which the transport drum holds the recording medium downstream of the second head unit in the rotational direction.

12. The liquid ejecting apparatus according to claim 10, further comprising a curing unit that is disposed downstream of the second head unit in the rotational direction and along a circumferential surface of the transport drum and cures the second liquid.

13. The liquid ejecting apparatus according to claim 1, wherein the first head unit has a first head, and a sealer that provided to protect the first head and made of the organic material, and wherein the second head unit has a second head, and a sealer that provided to protect the second head and made of the organic material.

14. The liquid ejecting apparatus according to claim 13, wherein the first head unit has a first head, and a sealer that provided to protect the first head and made of the organic material, and wherein the second head unit has a second head, and a sealer that provided to protect the second head and made of the organic material.

15. A liquid ejecting apparatus comprising:

a rotary member that rotates in a rotational direction;

a first head unit that is disposed along a circumferential surface of the rotary member, includes an organic material, and ejects a first liquid; and a second head unit that includes the organic material and ejects a second liquid, wherein the second liquid dissolves the organic material more than the first liquid, and wherein an angle which an ejection surface of the second head unit forms with a horizontal plane is smaller than an angle which an ejection surface of the first head unit forms with the horizontal plane.

16. The liquid ejecting apparatus according to claim 15, wherein the second head unit is disposed along the circumferential surface of the rotary member.

17. The liquid ejecting apparatus according to claim 15, wherein the second head unit is disposed downstream of the first head unit in the rotational direction.

18. The liquid ejecting apparatus according to claim 15, wherein the liquid ejecting apparatus includes a plurality of first head units that are disposed along the circumferential surface of the rotary member and eject the first liquid, and the angle which the ejection surface of the second head unit forms with the horizontal plane is smaller than any angles which ejection surfaces of the plurality of first head units form with the horizontal plane.

19. The liquid ejecting apparatus according to claim 15, wherein the ejection surface of the second head unit is substantially parallel to the horizontal plane.

20. The liquid ejecting apparatus according to claim 15, further comprising a support that supports a recording medium being transported, wherein the rotary member is an intermediate transfer member that transfers an intermediate image to the recording medium by a circumferential surface of the intermediate transfer member coming into contact with the recording medium on the support after the intermediate image is formed on the circumferential surface by ejection of the first liquid and the second liquid.

* * * * *